United States Patent [19]

Tornero

[11] Patent Number: 4,720,068

[45] Date of Patent: Jan. 19, 1988

[54] SEAT SUPPORT COLUMN

[76] Inventor: Lino E. Tornero, 629 Joyner St., Greensboro, N.C. 27403

[21] Appl. No.: 901,837

[22] Filed: Aug. 29, 1986

[51] Int. Cl.[4] ..... F16M 11/00

[52] U.S. Cl. ..... 248/161; 248/631

[58] Field of Search ..... 248/161, 162.1, 562, 248/415, 418, 631, 636, 407; 297/345, 347, 349; 188/300, 321.11; 267/64.12

[56] References Cited

U.S. PATENT DOCUMENTS

| | | | |
|---|---|---|---|
| 3,711,054 | 1/1973 | Bauer | 248/562 |
| 3,788,587 | 1/1974 | Stemmler | 248/631 |
| 3,790,119 | 2/1974 | Bauer | 248/161 |
| 4,245,826 | 1/1981 | Wirges | 188/300 |
| 4,415,135 | 11/1983 | French | 248/162.1 |
| 4,485,996 | 12/1984 | Beukema | 248/407 |
| 4,580,749 | 4/1986 | Howard | 248/161 |

*Primary Examiner*—Reinaldo P. Machado
*Assistant Examiner*—A. Chin-Shue
*Attorney, Agent, or Firm*—Charles R. Rhodes; Judith E. Garmon

[57] ABSTRACT

A seat is provided with a downwardly depending tubular casing having a generally open bottom except for a retainer therein. The base includes an open top support cylinder which receives the tubular casing therein. The piston of a gas or hydrapneumatic spring cartridge is mounted at the lower end of the support cylinder in axially and radially fixed relation thereto. Even though the gas spring (cartridge and piston) is capable of swiveling about its longitudinal axis relative to the support cylinder, the longitudinal axis of the gas spring (cartridge and piston) remains substantially vertical at all times. The casing is loosely received or floats within the support cylinder and loosely surrounds the cartridge. Near the upper end of the casing an internal wall operatively engages the upper end of the cartridge in such manner that movement of the cartridge along the piston rod causes a corresponding movement of the casing. Non-axial loads on the seat result only in a tipping of the casing with respect to the cartridge and support cylinder without tilting of the gas spring cartridge itself.

5 Claims, 3 Drawing Figures

SEAT SUPPORT COLUMN

BACKGROUND AND SUMMARY OF THE PRESENT INVENTION

This invention relates to adjustable support columns for seats, and more particularly to the mounting of seats on gas or pneumatic springs in such manner that the undesirable effects of side or non-axial loading are minimized.

Adjustable length support columns for mounting seats or stools on bases have become prevalent in institutional and commercial office furniture. Such support columns utilize gas or pneumatic springs which include essentially a pair of cylindrical telescoping members, one of which is connected to the underside of the seat and the other of which is connected to the base. The telescoping members are coupled by a gas or pneumatic spring. Developments in such coupling devices have thus far not effectively dealt with the objectionable effects of side or non-axial loads on the gas or pneumatic spring in such a manner as to ensure continued smooth operation of the device. Such side or non-axial loads occur when a person does not sit directly above the central longitudinal axis of the spring or support column. At such times, objectionable stress is placed upon the gas spring and more particularly, upon the point where the piston of the gas spring is attached to the base. These stresses frequently cause early failures in the gas or pneumatic springs, which result from either the binding between the piston rod and associated bearing surfaces, and/or the deformation of seals which result in the leakage of pressurized fluids and lubricants.

Two attempts to solving this problem are set forth in U.S. Pat. No. 3,711,054 to Bauer, and No. 4,485,996 to Beukema et al. The Bauer patent is illustrative of an attempt to minimize the stress problem by laterally displacing the gas spring piston rod with relation to the bottom of the support structure to which the free end of the piston rod is mounted. The results of this approach are only marginally effective in minimizing the stress problem since the longitudinal axis of the piston rod is no longer parallel to the axis of the support structure. Therefore the piston rod is not perpendicular to the lower swivel assembly and the action of the device is no longer smooth since the bottom shoulder of the piston rod does not properly contact or engage the swivel assembly bearing race. Further, the constant tipping of the piston rod with respect to the bearing race tends to cause deterioration of the bearing race and resulting improper operation of the swivel structure.

The Beukema et al patent illustrates another attempt to solve the side loading problem by providing an articulated joint between the upper portion of the pneumatic spring cartridge and the depending support post from the seat. This arrangement also fails to provide a satisfactory solution to the side loading problem because the operation is not smooth and binding frequently occurs.

The present invention, then, is directed to a coupling technique for mounting a seat on a base in such a manner that it is vertically adjustable and rotatable thereon and not subject to the objectionable effects of side loading as is the case in prior art devices. In general, in order to overcome the side loading problem the upper end of the tubular casing which depends from the seat platform rests upon the upper end of the gas spring cartridge in such a manner as to be radially movable or tiltable and rotatable with respect thereto. The support cylinder includes an annular bushing which normally holds the casing in vertical alignment; however, a slight tilt or radial shift thereof is possible responsive to side loading on the seat thereabove. Of primary importance in the present invention, the gas spring including the cartridge and piston, however, are maintained vertically erect and perpendicular to the lower mounting bearing at all times.

The lower end of the casing includes a retainer therein having an opening therethrough greater in diameter than the diameter of the gas spring piston rod and smaller than the diameter of the cartridge. Such construction prevents removal of the casing from the cartridge, yet allows for tilting of the casing relative to the cartridge and piston rod. The casing is supported on the upper end of the cartridge by means of swivel bearings so that the casing is rotatable thereon, and the piston rod is attached to the base of the support cylinder by means of a second bearing assembly which makes the gas spring rotatable with respect to the support cylinder. The upper end of the tubular member forming the gas cartridge leaves the cartridge pin exposed through an opening therein. The activating pin extends downwardly within the casing and engages the cartridge pin for activation thereof.

It should be noted here that the present invention is directed to a technique for coupling any type of gas cartridge between a seat and a base in such a manner as to negate the objectionable effects of side loading. The details of the gas spring are not critical to the invention; however, one type of gas spring which is known to be particularly adapted for use in conjunction with the present invention is that shown in applicant's co-pending application Ser. No. 671,292 filed Mar. 13, 1984 and entitled "Hydropneumatic Spring Cylinder," which application has now been issued as U.S. Pat. No. 4,616,812 issued Oct. 14, 1986.

It is therefore an object of the present invention to provide an improved coupling apparatus for joining the seat of a chair, such as an office chair, to a base in such a manner that it may be rotated and vertically adjusted.

It is another object of the present invention to provide an improved apparatus of the type described which negates the objectionable affects of side loading in such types of furniture.

Another object of the present invention is to provide an apparatus of the type described in which the seat and a tubular casing depending therefrom are, upon side loading, caused or permitted to tilt relative to the vertical axis of the gas spring and piston rod thereof.

Other objects and a fuller understanding of the invention will become apparent upon reading the following detailed description of the preferred embodiment along with the accompanying drawings in which.

DETAILED DESCRIPTION OF A PREFERRED EMBODIMENT

Figure 1:
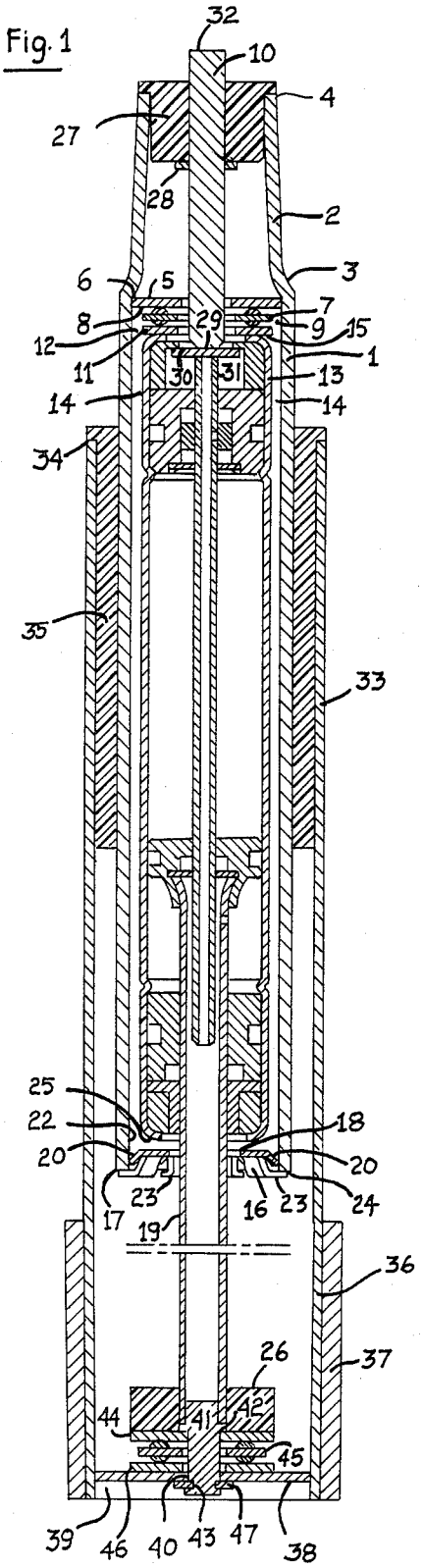
FIG. 1 is a sectional view of the apparatus according to the present invention.

Turning now to FIG. 1 there is illustrated the coupling apparatus for adjustably and rotatably mounting the seat of a chair or stool (not shown) to a base (not shown). Toward this end, and in general, the aforesaid apparatus includes a support cylinder 33, a gas spring formed of a cartridge 13 and piston rod 19, and a tubular casing 1 which is attached at the upper end to and depends from the underside of a seat.

The casing 1 includes a tubular lower portion and a frustoconically formed upper section 2, the two sections being joined by a transition zone 3 sharply reduced in diameter. The casing 1 terminates in an upper end 4 and a lower open end 17.

The aforesaid transition zone 3 creates an internal collar or annular abutment 6 against the underside of which is positioned a bearing race 5 having a central opening therein. A bearing retainer 7 engages the underneath surface 8 of the bearing race 5 and has an outside diameter which is less than the internal diameter of the casing 1, thus defining an area of clearance 9 between the periphery of bearing retainer 7 and the internal wall of the casing 1. Clearance 9 allows freedom of relative movement between the bearing 7 and the wall of casing 1 as will be hereinafter described. Similarly, the diameter of an opening in the bearing retainer is greater than the diameter of an activating pin 10 (to be later described) so that lateral displacement of the bearing retainer 7 relative to pin 10 may be accomplished without obstruction by either the internal wall of casing 1 or activating pin 10. A lower bearing race 11 is positioned beneath and in contact with the bearing retainer 7. As is the case with bearing retainer 7 the bearing race 11 is provided with an outer diameter considerably less than the internal diameter of casing 1, and an internal diameter considerably larger than the periphery of the activating pin or pin extension 10 so that lateral displacement of the bearing race 11 may be effected without interference with the activating pin 10 or the inner wall of casing 1.

The gas or pneumatic spring generally comprises a cartridge 13 and piston 19. As previously described, the internal workings of the gas cartridge are irrelevant to the present invention, it being sufficient to explain that the cartridge 13, during operation, is caused to reciprocate vertically along piston rod 19 to correspondingly raise and lower the seat through engagement with the casing 1 (or in reality through engagement with the upper bearing assembly 5, 7, 11). The cartridge 13 is provided with an outer diameter considerably less than that of the internal diameter of casing 1 so as to define an annular clearance 14 therebetween. The upper end of cartridge 13 engages and abuts the lower surface 15 of the lower bearing race 11 in such a way that relative lateral displacement between the bearing race 11 and casing 1 is permitted. The lateral displacement between casing 1 and cartridge 13 is permitted and defined by the tubular clearance 14.

Figure 3:
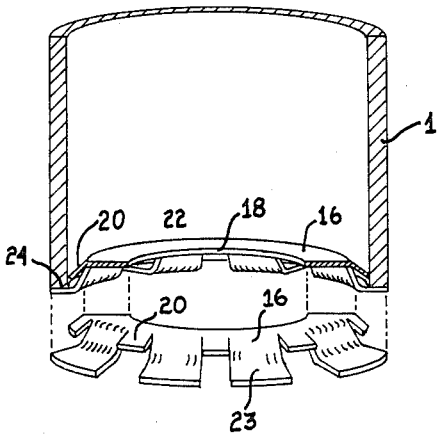
FIG. 3 is a perspective view, with parts broken away and in section, illustrating a unique type of retainer for enclosing the lower end of the casing.

A recessed cartridge retainer 16 (FIG. 3) encloses to some extent the lower open end 17 of casing 1. The recessed retainer 16 includes a central opening 18 having a diameter smaller than the diameter of cartridge 13, whereby the casing may not inadvertently be removed from cartridge 13; however, the casing 1 is free to laterally or radially displace relative to the cartridge 13. Further the bore 18 of retainer 16 is substantially larger than the diameter of the piston rod 19, so that casing 1 is also permitted to displace radially or laterally with respect to the piston rod 19 and without interference therewith.

The cartridge retainer 16 includes alternating teeth 20 and ears 23 in the manner commonly associated with star toothed retainers. So designed, the teeth 20 are pressed fit into the internal wall 22 of casing 1 to secure the retainer 16 in place. The interspaced ears 23 abut against the lower end face 24 of casing 1 to prevent upward axial displacement of the cartridge retainer 16 relative to the lower end face 24 of casing 1. The recessed construction of retainer 16 prevents contact between the lower end 25 of cartridge 13 and a bumper 26 when the cartridge is fully compressed, which bumper 26 will be explained more fully hereinafter in association with the lower mounting assembly.

The activating pin assembly 10 is guided through the upper end 4 of casing 1 by means of a guide plug 27 and retained therein by a spring clip 28. So arranged, the activating pin extension 10 is allowed to reciprocate within the guide plug 27 for a distance equal to the length of the stroke necessary to activate the cartridge pin 31. The lower end 29 of activating pin extension 10 rests upon the upper surface 30 of the cartridge pin 31 in such a way that a force applied to the top 32 of activating pin extension 10 is transmitted to the cartridge pin 31 initiating the gas exchange within the gas frame device. Activating pin 10 is positioned in concentric arrangement to the internal openings in bearing race 5, bearing retainer 7, and bearing race 11, in such a way that the lateral displacement of the bearing retainer 7, bearing race 11, and cartridge 13 does not interfere with the activating pin 10, and the upper surface 30 of cartridge pin 31 can laterally displace relative to the lower surface 29 of actuating pin 10.

A mounting support structure includes a tubular support cylinder 33, generally open at the upper end, which is provided with an elongated annular bushing 35 for the guided axial reciprocation and swivelling motion of the casing 1 therein. Bushing 35 is relatively stiff to provide guidance for casing 1, however, side loads created by sitting on the seat edge are so great that bushing 35 will give slightly to permit the aforesaid tilt or lateral shift. The support cylinder 33 includes a lower, frustoconical section 36 which is received in frictional engagement with a matching frustoconically shaped, tubular hub 37. The hub 37 is a part of the wheeled base of the chair. An annular mounting plate 38 is formed integrally with or secured within the lower end 39 of the tubular member 33 by means of welding or the like and includes a central opening 40.

The lower end of piston rod 19 is sealed by a plug 41, which plug is provided with a shoulder 42 and a groove 43. The plug 41 is supported on the annular mounting plate 38 in such a way that it is allowed to swivel relative to the support cylinder 33. For this purpose a bearing race 44 engages the shoulder 42 of plug 41 and a lower bearing race 46 is received by the annular mounting plate 38. A bearing retainer 45 is positioned between the upper bearing race 44 and lower bearing race 46 for the rotational motion hereinabove described. A spring clip 47 retains the plug 41 and piston rod 19 from axial displacement relative to the annular mounting plate 38 at support cylinder 33.

Thus, the casing 1 and the gas spring cartridge 13 are free to rotate about their longitudinal axis and to telescopically reciprocate within the interior of and relative to the longitudinal axis of the support cylinder 33, the casing 1 normally retained in a vertically oriented position by the bushing 35. The piston rod 19 is also capable of rotation about its longitudinal axis, yet is not permitted to axially displace relative to the support structure or cylinder 33.

Figure 2:
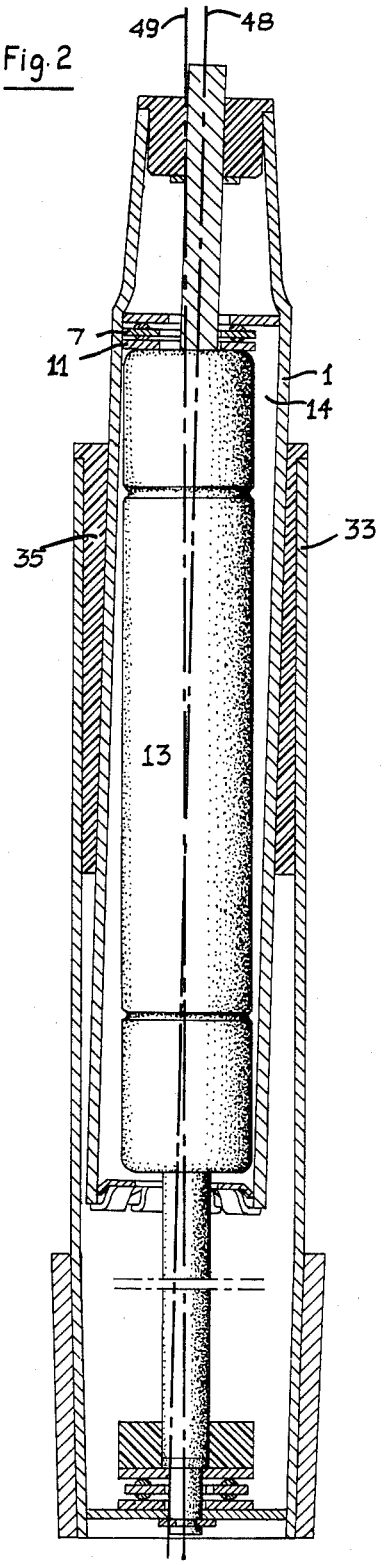
FIG. 2 is a sectional view similar to FIG. 1, except showing the apparatus under conditions of side loading.

Looking at FIG. 2, the device of the present invention exaggeratedly is shown under a condition of extreme side loading. In such situations, while the longitudinal axis 49 of support cylinder 33, piston rod 19, and cartridge 13 all remain substantially vertical, the longitudinal axis 48 of casing 1 may be caused to tip or tilt. Thus, objectionable forces normally exerted on the cartridge 13 or at the point of mounting of the piston rod with the enclosed lower end of the support cylinder are negated.

While a preferred embodiment of the invention has been described in detail hereinabove, it is apparent that various changes and modifications might be made without departing from the scope of the invention which is set forth in the accompanying claims.

What is claimed is:

1. Apparatus for adjustably and rotatably mounting the seat of a chair or stool to a base comprising:

(a) a support cylinder, a height adjusting gas spring, and a generally tubular casing secured to the underside of said seat;

(b) said support cylinder including an annular mounting plate adjacent the lower end thereof and a generally open top;

(c) said height adjusting gas spring including a gas cartridge having a diameter less than the diameter of said support cylinder with a piston rod protruding from one end thereof, a cartridge pin adjacent the other end of said gas cartridge, said gas cartridge being vertically reciprocal along said piston rod responsive to depression of said cartridge pin;

(d) the free end of said piston rod being attached to said annular mounting plate in such a manner as to be rotatable thereon, but radially and axially fixed with respect thereto, whereby said height adjusting cartridge is substantially disposed within the support cylinder in parallel spaced relation to the cylindrical wall thereof;

(e) the longitudinal axes of said support cylinder, said piston rod, and said gas cartridge being colinear with respect to each other and remain substantially vertically erect at all times;

(f) said tubular casing having an upper section and a generally cylindrical lower section, the lower section having a diameter greater than the diameter of said gas cartridge and less than the diameter of said support cylinder, a collar means for substantially enclosing the upper end of said lower section, the lower end of said casing being generally open, and said cartridge providing substantially the entire support for said casing;

(g) an activating pin extending through the upper end of said casing and said activating pin engages said cartridge pin through an opening in an upper wall of said cartridge; said activating pin being radially or laterally movable with respect to said cartridge pin for selective activation thereof;

(h) the longitudinal axis of said casing being tiltable or laterally shiftable with respect to the longitudinal axes of said support cylinder, piston rod, and height adjusting cartridge responsive to non-axial or side loads on said seat member, whereby the damaging or objectionable effects of such side loads are minimized.

2. The apparatus according to claim 1 and further including a rotatable bearing member connecting the upper end of said gas cartridge with the collar means of said casing.

3. The apparatus according to claim 1 wherein an annular or tubular bushing is provided on the inner surface of said support cylinder adjacent the upper end thereof for normally retaining said casing in generally vertical position during reciprocation and rotation thereof.

4. The apparatus according to claim 1 and further including a retainer means adjacent the lower end of said casing for preventing inadvertent axial displacement of said casing relative to said cartridge.

5. Apparatus for coupling the seat of a seat or stool to a base comprising:

(a) a support cylinder extending upwardly from said base, a tubular casing depending from said seat, and a height adjusting gas spring secured at the lower end thereof to said support cylinder;

(b) the longitudinal axes of said support cylinder and said gas spring being maintained vertically erect at all times;

(c) means for mounting said tubular casing to the upper end of said gas spring that the longitudinal axis of said tubular casing is normally vertically erect, however, is capable of lateral displacement or tilt relative to said gas spring responsive to non-axial or side loads on said seat, whereby objectionable effects of side loads are negated and an activating pin engages a cartridge pin of said gas spring through an opening in an upper wall of said gas spring, said activating pin being radially or laterally movable with respect to said cartridge pin.

* * * * *